US005474037A

United States Patent [19]

Paul

[11] Patent Number: 5,474,037

[45] Date of Patent: Dec. 12, 1995

[54] VALVE TRAIN FOR AN INTERNAL COMBUSTION ENGINE

[75] Inventor: Michael Paul, Bad Friedrichshall, Germany

[73] Assignee: Audi AG, Germany

[21] Appl. No.: 255,060

[22] Filed: Jun. 7, 1994

[30] Foreign Application Priority Data

Jun. 24, 1993 [DE] Germany ..... 43 20 992.0
Jun. 26, 1993 [DE] Germany ..... 43 21 308.1

[51] Int. Cl.[6] ..... F01L 1/18; F01L 1/12

[52] U.S. Cl. ..... 123/90.16; 123/90.44

[58] Field of Search ..... 123/90.15, 90.16, 123/90.17, 90.27, 90.39, 90.44, 90.65, 90.67, 188.12

[56] References Cited

U.S. PATENT DOCUMENTS 2,117,433 5/1938 Krebs ..... 123/90.65
4,787,346 11/1988 Ajiki et al. ..... 123/90.16
4,957,076 9/1990 Inoue et al. ..... 123/90.16
4,970,997 11/1990 Inoue et al. ..... 123/90.16
5,095,859 3/1992 Iwata et al. ..... 123/90.16
5,101,778 4/1992 Fukuo et al. ..... 123/90.16
5,159,905 11/1992 Sugiuchi et al. ..... 123/90.16

FOREIGN PATENT DOCUMENTS 264253 4/1988 European Pat. Off. .
3800347 9/1988 Germany .

*Primary Examiner*—Henry C. Yuen
*Assistant Examiner*—Weilun Lo
*Attorney, Agent, or Firm*—Lalos & Keegan

[57] ABSTRACT

A valve train with a variable valve timing mechanism for at least one intake or exhaust valve E has a cam shaft with a low-speed cam and a high-speed cam. A first rocker lever interacts with the low-speed cam and the valve E. A second rocker lever interacts with the high-speed cam and can be connected to the first rocker lever via a coupling pin. To press the second rocker lever against its cam, a spring system is provided and this is formed by at least one spring, which, during the base circle phase, rests in a prestressed state directly or indirectly against a fixed stop and the rocker lever is thus relieved of load in order to reduce friction and wear.

6 Claims, 5 Drawing Sheets

VALVE TRAIN FOR AN INTERNAL COMBUSTION ENGINE

BACKGROUND OF THE INVENTION

This invention relates to a valve train for an internal combustion engine.

In valve trains of this kind, which are known, for example, from German. Patent 3,800,347, the first rocker lever or levers is/are pressed against the first cam or cams by the valve spring of the associated valve, while a separate spring is provided to press the second rocker lever against its cam. This spring must be designed so that the second rocker lever rests against its cam continuously over the entire rotational speed range, i.e. both during the base circle phase and during the lift phase, for which purpose the spring force required corresponds approximately to that of the valve spring. Due to the relatively large, continuously acting contact force, increased wear occurs on the second cam and on the second rocker lever. In order to reduce this wear, a known proposal (EP-A 264 253) is to provide two springs of different strengths arranged in series and supported on one another for the purpose of pressing the second rocker lever against its cam, the stronger spring being relaxed and the rocker lever being pressed against its cam only by the weaker spring during the base circle phase. In the lift phase, the weaker spring is first of all compressed and then the stronger spring is compressed via the weaker spring, with the result that the second rocker lever is then acted upon by a large contact force, which is required in order to ensure contact of the second rocker lever with its cam during the lift phase. The disadvantage here is that, during the transition from the base circle phase to the lift phase, only a fraction of the spring force of the stronger spring is initially effective after the compression of the weaker spring, since it was previously in a relaxed state and, assuming the normal linear spring characteristic, only develops its full spring force with a certain compression, as a result of which it is necessary to have a very stiff spring with a high spring rate which can lead to an excessive contact force at the maximum lift.

It is the object of the invention, in a valve train of the generic type, to achieve a reduction in the friction and wear of the second rocker lever against its cam.

This object is achieved according to the invention by virtue of the fact that the spring rests directly or indirectly, under prestress, against a fixed stop, from which it is only raised after the cam base circle phase has been passed through by the second rocker lever.

SUMMARY OF THE INVENTION

In the proposal according to the invention, in a first illustrative embodiment with a weaker and a stronger spring, the second rocker lever is pressed against its cam during the base circle phase only by the weaker spring. At the beginning of the lift phase, however, the stronger spring is immediately effective to a considerable degree after the compression of the weaker spring since it is not compressed from a relaxed state but acts immediately with the selected prestress on the second rocker lever. This ensures continuous contact of the second rocker lever with its cam even at high rotational speeds.

The stronger spring can be supported on the fixed stop via a displaceable spring plate, on the side of which that faces away from the spring a second rocker lever is supported via the weaker spring. The weaker spring can be formed by an elastomer part or, alternatively, by a spring washer.

The stronger spring can be a helical spring which is arranged on a fixed tube accommodating a spark plug or an injection valve, between a first spring plate connected to the tube and a second spring plate arranged displaceably on the tube. The second spring plate has a tubular extension which surrounds the tube and is supported against the fixed stop. The weaker spring surrounds the extension and is supported on that side of the second spring plate which faces away from the stronger spring, and the second rocker lever rests against the weaker spring via a supporting ring which surrounds the extension and is displaceable relative to the latter. The supporting ring is expediently composed of a wear-resistant material while the second spring plate together with the tubular extension can be composed of light alloy in order to save weight. The weaker spring can be connected both to the supporting ring and to the second spring plate to form a unit.

In the second illustrative embodiment of the invention with just one spring, there is no contact at all between the second rocker lever and its cam during the base circle phase, with the result that sliding contact occurs only during the lift phase. By virtue of the fact that the spring presses the second rocker lever against the stop, the second rocker lever is pressed against its cam with the prestressing force of the spring immediately at the beginning of the lift phase which results in the raising of the second rocker lever from the stop, and this ensures contact between the second rocker lever and its cam during the lift phase, even at high rotational speeds.

The spacing between the sliding surface of the second rocker lever and its cam during the base circle phase can correspond to the customary valve clearance and thus amounts to only a fraction of a millimeter.

BRIEF DESCRIPTION OF THE DRAWINGS

Two illustrative embodiments of the invention are described below with reference to the drawings, in which.

DETAILED DESCRIPTION

Figure 1:
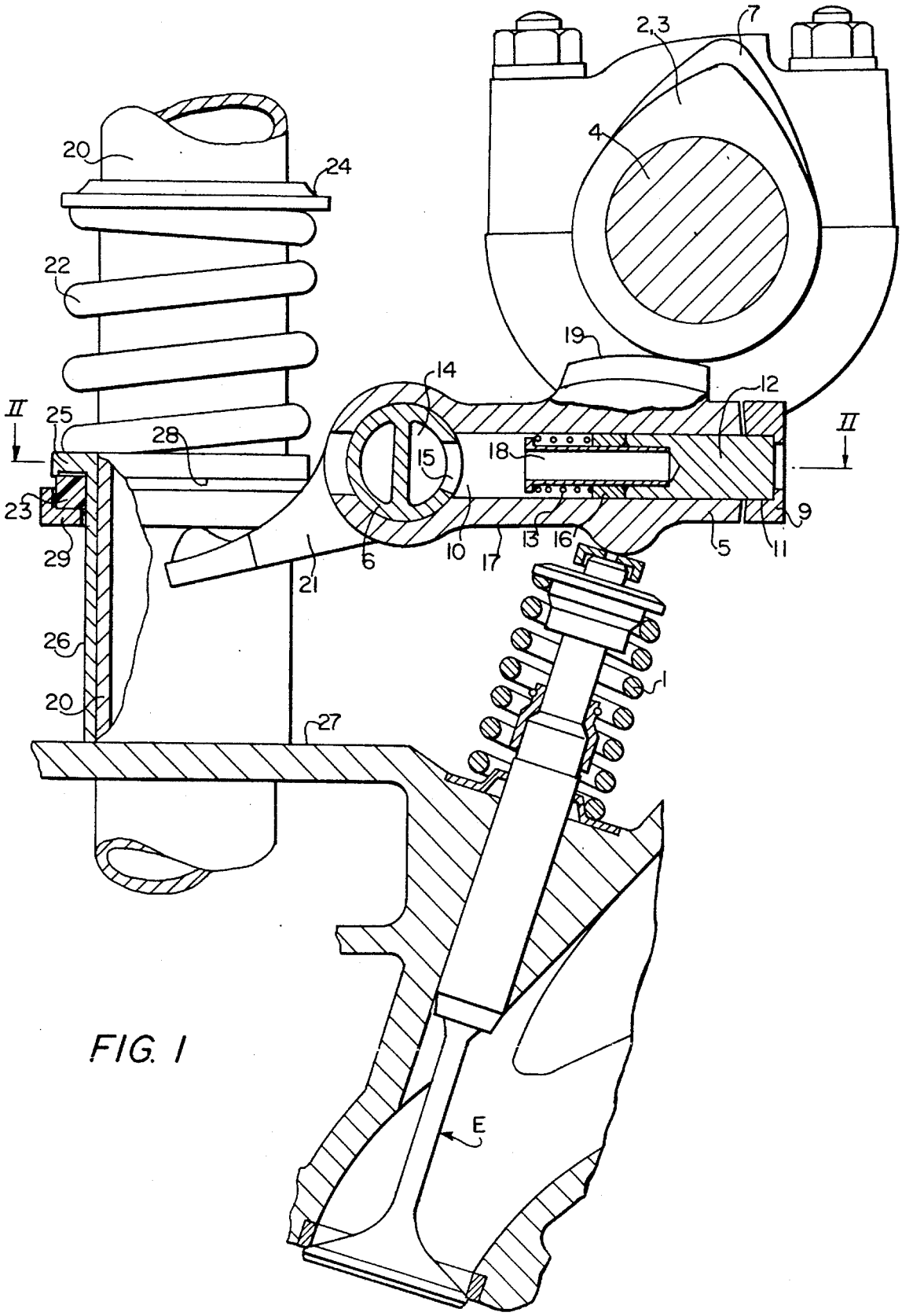
FIG. 1 shows a valve train in vertical section along the line I—I in FIG. 2.
Figure 2:
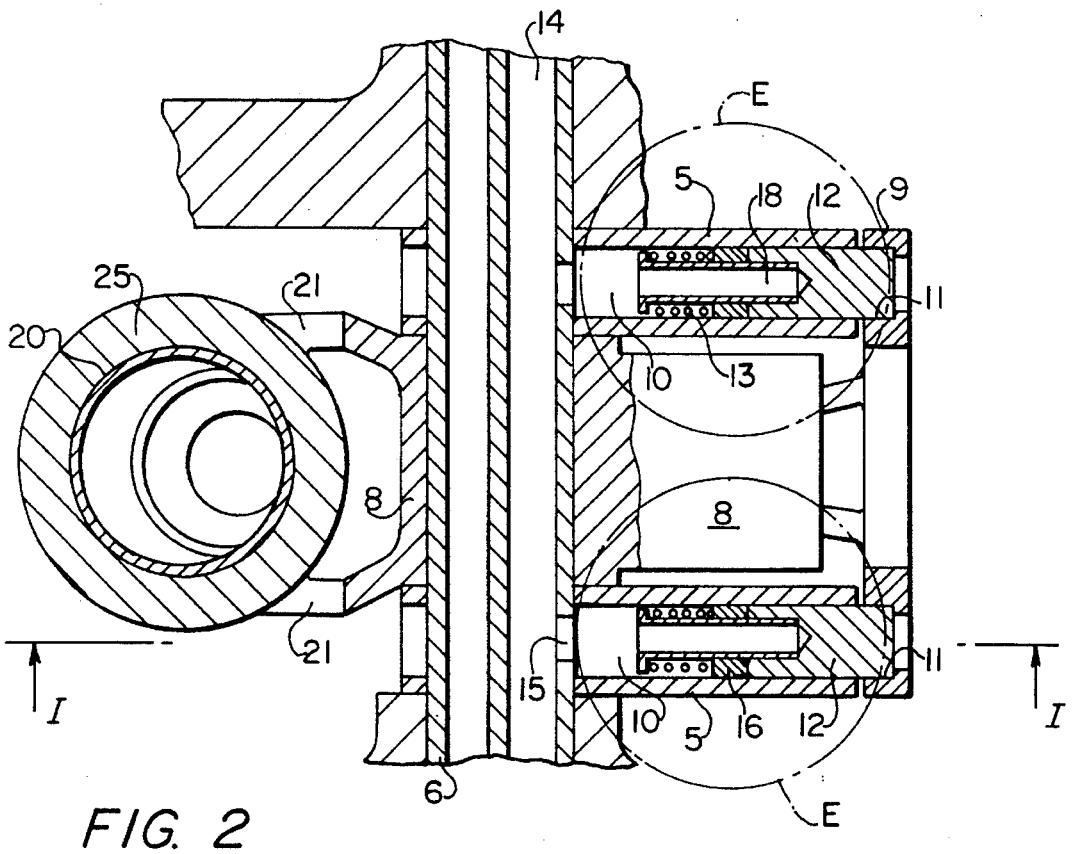
FIG. 2 shows a section along the line II—II in FIG. 1.
Figure 3:
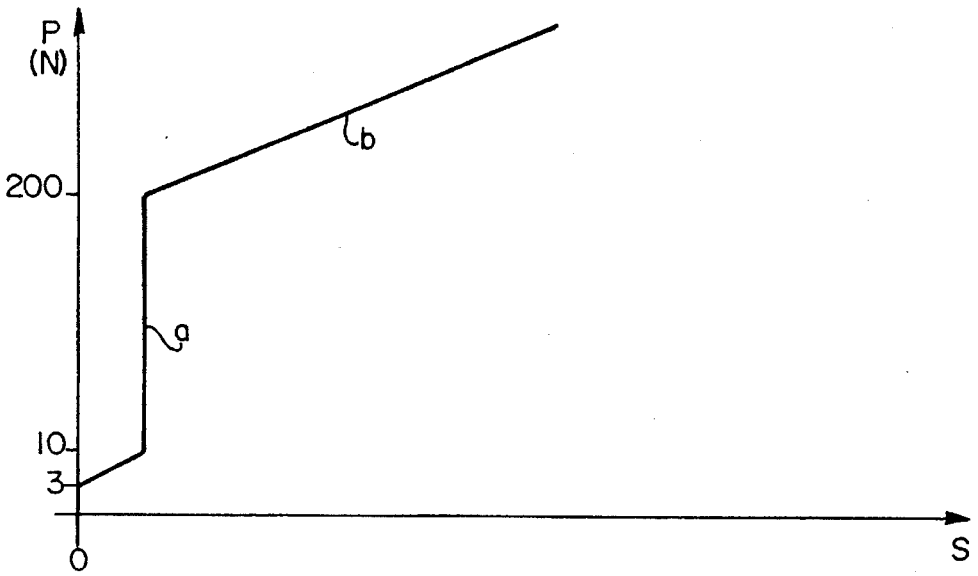
FIG. 3 shows a diagram which shows the variation of the contact force acting on the second rocker lever.

FIGS. 1–3 of the drawing depict a valve train for two intake valves E. Each valve E is acted upon in the closing direction by a spring 1. The valves are actuated by their own cams 2, 3 of a cam shaft 4 via first rocker levers 5 which are pivotably supported on a common fixed pin 6 and are held in contact with their cams 2, 3 by the valve springs 1 during their lift phases. The cams 2 and 3 preferably have different cam profiles in order to achieve a different valve lift, a different opening duration and/or different control periods for the individual intake valves and to create optimum conditions in the lower and medium rotational speed range of the internal combustion engine.

Arranged on the cam shaft 4 between the two cams 2 and 3 is a further cam 7, the cam profile of which is designed for the conditions in the upper rotational speed range of the internal combustion engine, for example a larger valve lift and a longer opening duration. A second rocker lever 8 interacts with the cam 7 and this second rocker lever can be coupled to the first rocker levers 5 in the upper rotational speed range, with the result that in this rotational speed range the valves E are actuated in accordance with the contour of cam 7.

The free end of the second rocker lever 8 is provided with a cross-bar 9 which extends in front of and at a short distance from the free ends of the first rocker levers 5. Holes 10 radial to the pivot pin 6 are provided in the first rocker levers 5 and these holes 10 are in alignment with holes 11 in the cross-bar when the valves E are in their closed position, i.e. when the rocker levers 5 and 8 are running on the base circles of their cams 2, 3 and 7. Arranged in each hole 10 is a piston 12 which can be displaced between a first, inner position (FIG. 2) and a second, outer position (FIG. 1) in which it engages in the corresponding hole 11 in the cross-bar 9. In the second position, the pistons 12 thus connect the first rocker levers 5 to the second rocker lever 8 and the valves are thus actuated in accordance with the contour of cam 7.

The displacement of the pistons 12 towards the outside takes place with the aid of a pressure medium which is supplied through a passage 14 in the pin 6, the passage 14 being connected to the holes 10 via openings 15 in the wall of the pin 6. If the supply of pressure medium is interrupted, the pistons 12 are each moved back into their holes 10 by a spring 13 and the second rocker lever 8 can then oscillate freely and the actuation of the valves takes place by means of the first rocker levers 5 in accordance with the contour of cams 2 and 3 respectively. The spring 13 is supported at one end against an insert 16 fixed in the hole 10 and at the other end against the end 17 of a tube 18 which is secured on the piston 12 and extends through the insert 16.

Each rocker lever 5 and 8 has a sliding surface 19 by which it rests against its cam 2, 3 and 7 respectively.

The second rocker lever 8 is held in contact with its cam 7 by a spring system which, in the illustrative embodiment shown in FIGS. 1–3, is arranged on a tube 20 accommodating a spark plug or an injection valve and acts on extensions 21 of the second rocker lever 8, the said extension partially surrounding the tube 20. The spring system (cf. FIG. 1) comprises a first, stronger spring 22, which is formed by a helical spring, and a second, weaker spring 23, which is formed by an elastomer ring. The first spring 22 is arranged under prestress between a first spring plate 24 connected to the tube 20 and a second spring plate 25, which is seated displaceably on the tube 20 and has a tubular extension 26 which is supported against a fixed stop 27 formed by a surface on the cylinder head of the internal combustion engine. The second spring 23 is supported on that side 28 of the second spring plate 25 which faces away from the spring 22 and the extensions 21 of the second rocker lever 8 are supported via a supporting ring 29, seated displaceably on the extension 26, on the second spring 23. The second spring 23 can be connected to the supporting ring 29 and to the second spring plate 25 to form a unit.

During the base circle phase shown in FIG. 1, in which the rocker levers 5 and 8 run on the base circles of their cams 2, 3 and 7 respectively, the second rocker lever 8 is pressed against its cam 7 only by the weak second spring 23 since the strong spring 22 is supported against the fixed stop 27 via the tubular extension 26. After the base circle phase has been passed through and at the beginning of the lift phase, the rocker levers 5 and 8 are pivoted about the pin 6 in the clockwise direction, the extensions 21 of the rocker lever 8 compressing the second spring 23 until it forms a rigid block, and then come under the influence of the prestressed spring 22. Immediately after the beginning of the lift phase, the second rocker lever 8 is thus pressed against its cam 7 with a force which corresponds to the prestress of the first spring 22, and this contact force rises in accordance with the characteristic of the spring 22 as the pivoting angle increases.

FIG. 3 shows a diagram which illustrates, in principle, the variation of the contact force acting on the second rocker lever 8 during the lift phase. In this diagram, P is the contact force and s the displacement of the supporting ring 29 in accordance with the pivoting of the second rocker lever 8 by the cam 7. Up to the beginning of the lift phase at point 0, the rocker lever 8 is subject only to the prestressing force of the second spring 23, which is, for example, 3N. At the beginning of the lift phase, the second spring 23 is first of all compressed into a rigid block, as a result of which the contact force rises to, for example, 10N. At this moment, the prestress of the first spring 22 comes into effect, this prestress being illustrated in the diagram by section a, as a result of which the contact force acting on the rocker lever 8 is increased to, for example, 200N. The contact force then rises in accordance with the course of the line b, which is defined by the characteristic of the spring 22.

From the diagram in FIG. 3, it can be seen that in the base circle phase the rocker lever 8 is pressed against its cam 7 with only a small force. Immediately after the beginning of the lift phase, however, a high contact pressure is present due to the prestress of the first spring 22 and this contact pressure ensures that the rocker lever 8 rests continuously against its cam 7 by its sliding surface 19 even at high rotational speeds.

Figure 4:
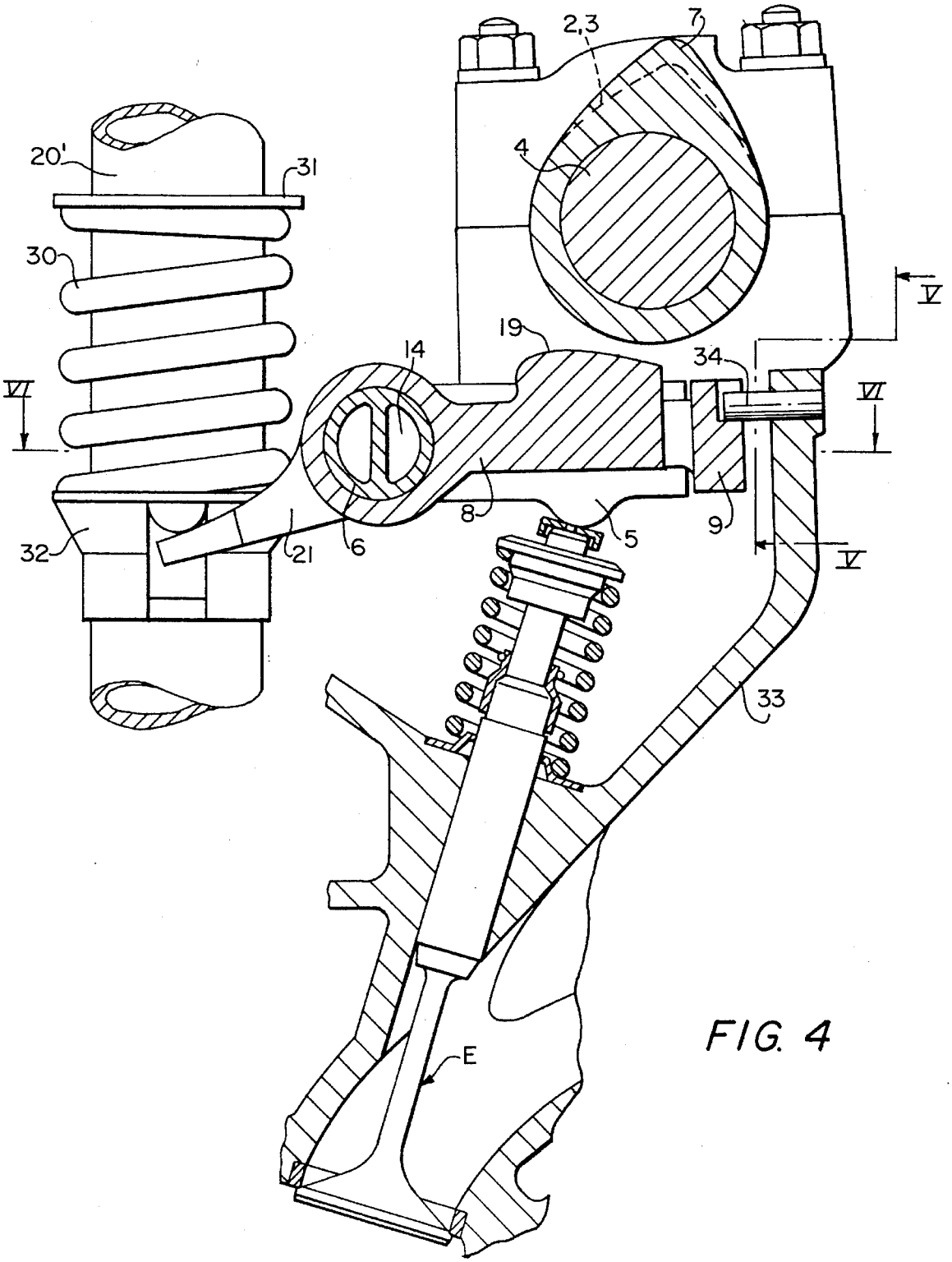
FIG. 4 shows another valve train similar to that in FIG. 1 in a section along the line IV—IV in FIG. 5.
Figure 5:
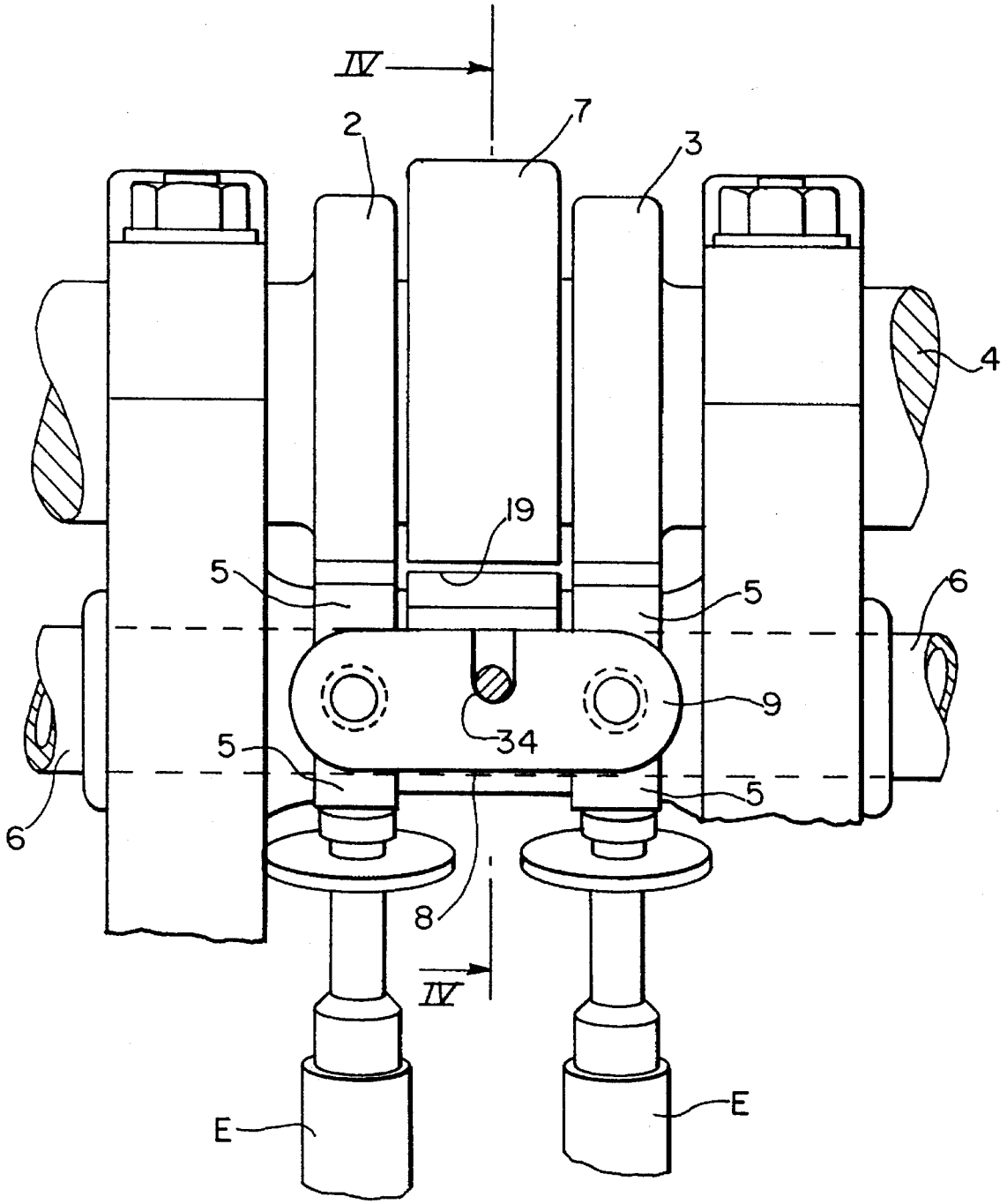
FIG. 5 shows a section in accordance with the line V—V in FIG. 4 and, finally.
Figure 6:
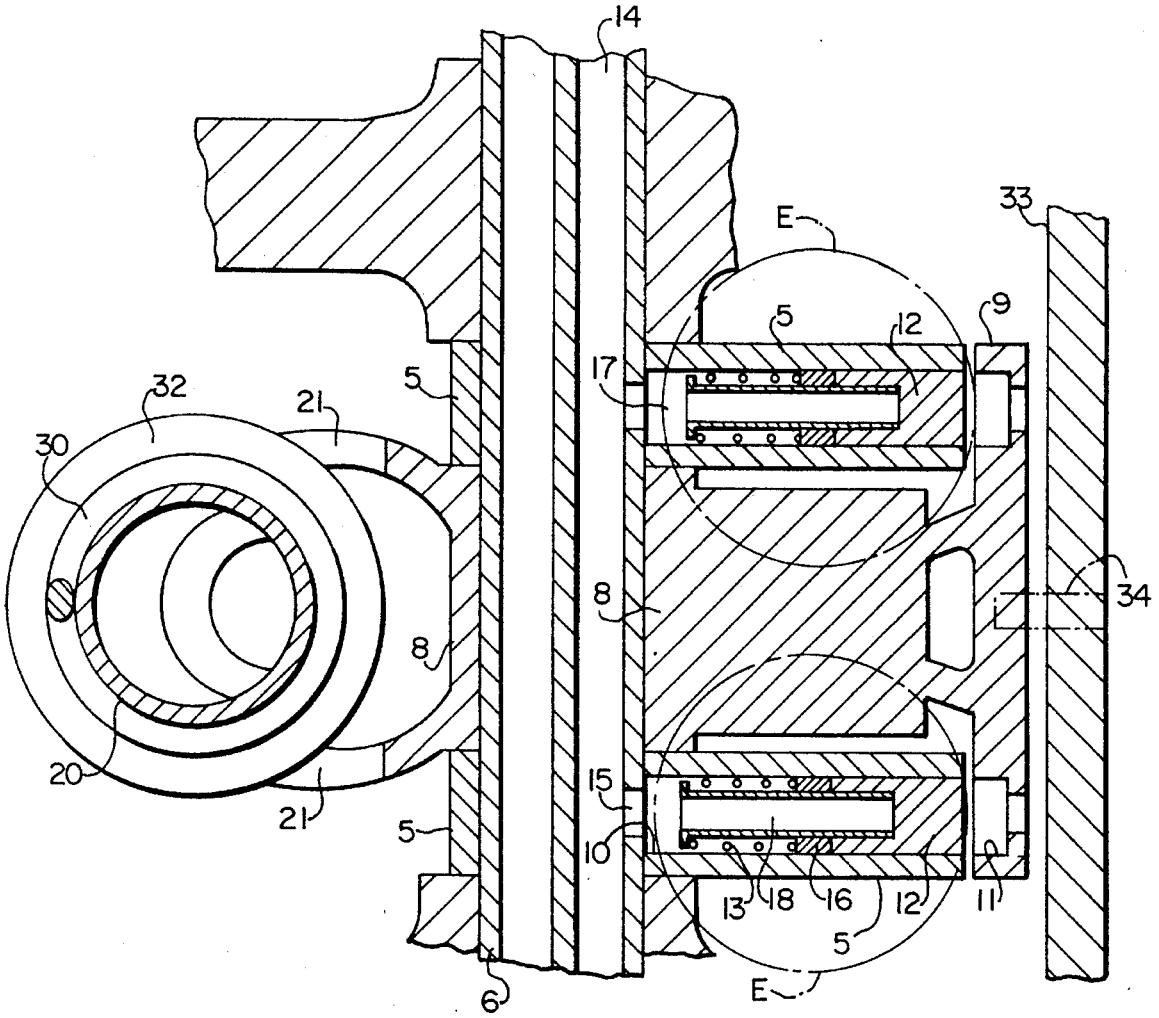
FIG. 6 shows a section along the line VI—VI in FIG. 4.

FIGS. 4–6 show a further illustrative embodiment of the invention. Identical parts are provided with identical reference numerals and are not described again.

In this arrangement, the second rocker lever 8 is pressed against the cam 7 by its sliding surface 19 in the lift phase by means of a single helical compression spring 30, the spring 30 lying under prestress on a tube 20' between a first spring plate 31 connected to the tube 20' and a second spring plate 32 arranged displaceably on the tube 20'. The spring plate 32 is supported against the extensions 21 of the second rocker lever 8, which partially surround the tube 20'.

A stop 34 is provided on the fixed component 33, which is normally part of the cylinder head of the internal combustion engine, and the second rocker lever 8 is pressed against this stop 34 by the spring 30 in its base circle phase. The arrangement is such that the sliding surface 19 is not in contact with the base circle of the cam 7, this being illustrated in an exaggerated manner for the sake of clarity in FIG. 4. In practice, the spacing between the sliding surface 19 and the cam base circle is of the order of the normal valve clearance. This arrangement avoids the occurrance of friction between the sliding surface 19 and the cam 7 in the base circle phase. After the base circle phase has been passed through and at the beginning of the lift phase, the second rocker lever 8 is raised from the stop 34 by the lobe of the cam 7, as a result of which it comes under the influence of the prestressed spring 30 and is pressed against the lobe of the cam 7 with a corresponding force. This contact force increases in accordance with the characteristic of the spring 30 as the second rocker lever 8 is pivoted to an increasing extent by the lobe of the cam 7.

Thus, on the one hand, the total friction between the rocker lever 8 and the cam 7 is reduced, since sliding contact occurs only in the lift phase, and, on the other hand, the prestress of the spring 30 acts immediately at the beginning of the lift phase to press the rocker lever 8 against the lobe of the cam 7.

The invention is not limited to the illustrative embodiments depicted but can also be used for a valve-actuating mechanism for just one valve or for more than two valves, with variable valve timing, per cylinder. The invention can, in principle, also be used for valve timing mechanisms of different construction in which a rocker lever which does not act directly on a valve is pressed against its cam by its own spring.

I claim:

1. Valve train for an internal combustion engine with a plurality of cylinders comprising:

at least one intake and one exhaust valve per cylinder;

a valve (E);

a cam shaft (4) including a first cam (2 or 3) and a second cam (7);

a first rocker lever (5) which interacts with said valve and said first cam for a first rotational speed range;

a second rocker lever (8) which interacts with said second cam for a second rotational speed range, and first spring (22) for maintaining said second rocker lever in contact with said second cam;

a coupling means for selectively coupling said first and second rocker levers;

and further including a fixed tube (20), a first spring plate (24) connected to said tube, a second spring plate (25) arranged displaceably on said tube, and wherein said first spring is arranged on said tube between said first and second spring plates, and wherein said second spring plate is displaced only after a cam base circle of said second cam has passed through on said second rocker lever, and further including a second spring (23) that is relatively weaker than said first spring, and wherein said second spring is arranged on said tube, and wherein said first spring is a helical spring;

said second spring plate includes a tubular extension (26) that surrounds said tube;

and further including a fixed stop (27) that supports said tubular extension;

and wherein said second spring surrounds said tubular extension and is supported on a side of said second spring plate that faces away from said first spring;

and including a supporting ring (29) that surrounds said tubular extension and is displaceable relative to said extension; and wherein said second rocker lever rests against said second spring via said supporting ring.

2. Valve train according to claim 1 wherein said second spring is formed of an elastomer part.

3. Valve train according to claim 1 wherein said tube accommodates a spark plug.

4. Valve train according to claim 1 wherein said tube accommodates an injection valve.

5. Valve train according to claim 1 wherein said second spring, said supporting ring and said second spring plate are connected together to form a unit.

6. Valve train according to claim 1 wherein said second spring plate and said tubular extension are composed of a light alloy.

* * * * *